United States Patent [19]

Gilmore

[11] 4,087,236

[45] May 2, 1978

[54] AUTOMATIC CANDLE FEEDER

[76] Inventor: Chace D. Gilmore, 1224 Pottstown Pike, West Chester, Pa. 19380

[21] Appl. No.: 696,922

[22] Filed: Jun. 17, 1976

[51] Int. Cl.[2] ..... F23D 3/16

[52] U.S. Cl. ..... 431/290; 431/288

[58] Field of Search ..... 431/290, 288, 289

[56] References Cited

U.S. PATENT DOCUMENTS

| | | | |
|---|---|---|---|
| 179,547 | 7/1876 | Folk | 431/219 |
| 416,045 | 11/1889 | Becker | 431/290 |
| 3,905,746 | 9/1975 | Patrikios | 431/290 |

FOREIGN PATENT DOCUMENTS

| | | | |
|---|---|---|---|
| 1,280,056 | 11/1961 | France | 431/290 |
| 1,962,049 | 6/1971 | Germany | 431/290 |

*Primary Examiner*—Edward G. Favors
*Assistant Examiner*—Robert J. Charvat
*Attorney, Agent, or Firm*—Charles A. Weigel, Jr.

[57] ABSTRACT

A passive device for automatically feeding a candle to a fixed support ring is mounted upon a base member. A lower drive ring is urged upwardly to force the candle against the fixed support ring by a weight ring. The weight ring is linked to the lower drive ring by flexible linkages which are looped over plural pulley-like guideways secured to the fixed suport such that the weight of the ring urges the candle upwardly. The upward movement of the candle ceases when the candle is burned out and the lower drive ring engages the fixed support ring.

5 Claims, 4 Drawing Figures

AUTOMATIC CANDLE FEEDER

BACKGROUND OF THE INVENTION

This invention relates to an automatic candle feeder and, more particularly, to a candle holder which acting under the influence of a passive weight member operates to urge the candle upwardly to a fixed burning position.

Many devices have been devised for holding candles. Among these devices have been hollow cylindrical holders having top supports which restrain the upward movement of the candle and yet permit the wick to extend therethrough for burning purposes. The lower end of the candle is urged upwardly by a spring or by a springloaded member.

While these devices are quite satisfactory, they tend with time to wear out whether by way of friction, the spring becoming broken, or other causes.

It is, therefore, an object of this invention to provide a more reliable, long-lasting device for holding candles.

Another object of this invention is to provide a passive device for urging candles upwardly to a fixed burning position.

BRIEF DESCRIPTION OF THE INVENTION

In accordance with a preferred embodiment of this invention, an automatic candle feeder includes a base, a fixed top support ring mounted on said base and adapted to engage the top peripheral portions of said candle, a lower drive ring adapted to support and urge said candle upwardly toward said top support ring, a ring weight, plural guideways secured to said top support, flexible linkages slideably movable over said guideways linking said ring weight and said lower drive ring, thereby to urge said lower ring and hence said candle upwardly.

In a preferred embodiment the top support ring has an internal diameter less than the external diameter of the candle and preferably has a frusto-conical configuration adapted to form together with the candle a cup-like configuration, thereby to direct melting wax toward the center of the ring.

BRIEF DESCRIPTION OF THE DRAWINGS

The invention, both as to its organization and method of operation, will be further understood from the following description when read in connection with the accompanying drawings which are not limitative and in which:

FIG. 1 is an elevation view of an automatic candle feeder constructed in accordance with a preferred embodiment of this invention;

DESCRIPTION OF THE PREFERRED EMBODIMENT

Figure 2:
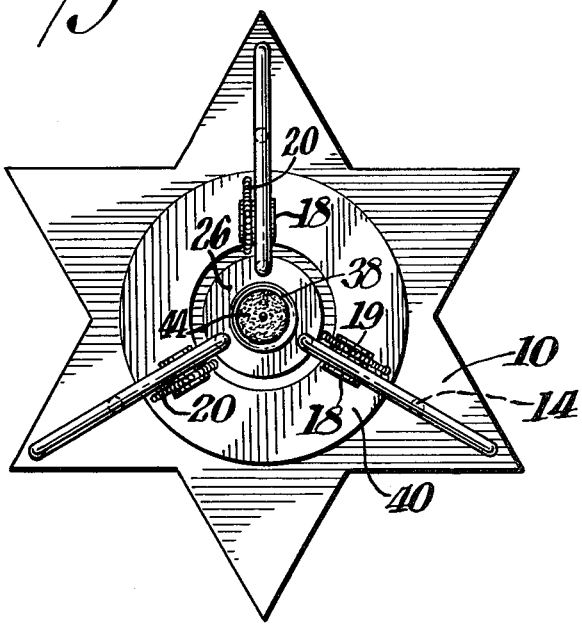
FIG. 2 is a plan view of the automatic candle feeder illustrated in FIG. 1 without the shade.
Figure 4:
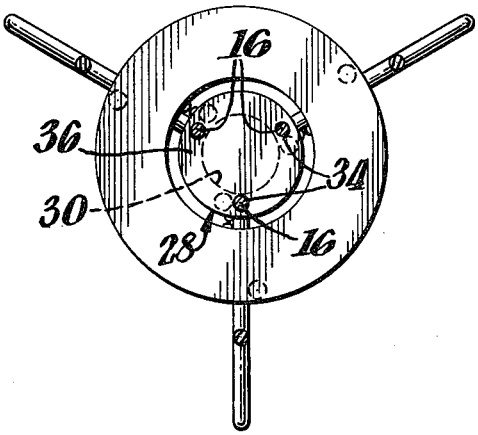
FIG. 4 is a bottom view of the weight ring taken through the section line 4—4 of FIG. 1.
Figure 2:
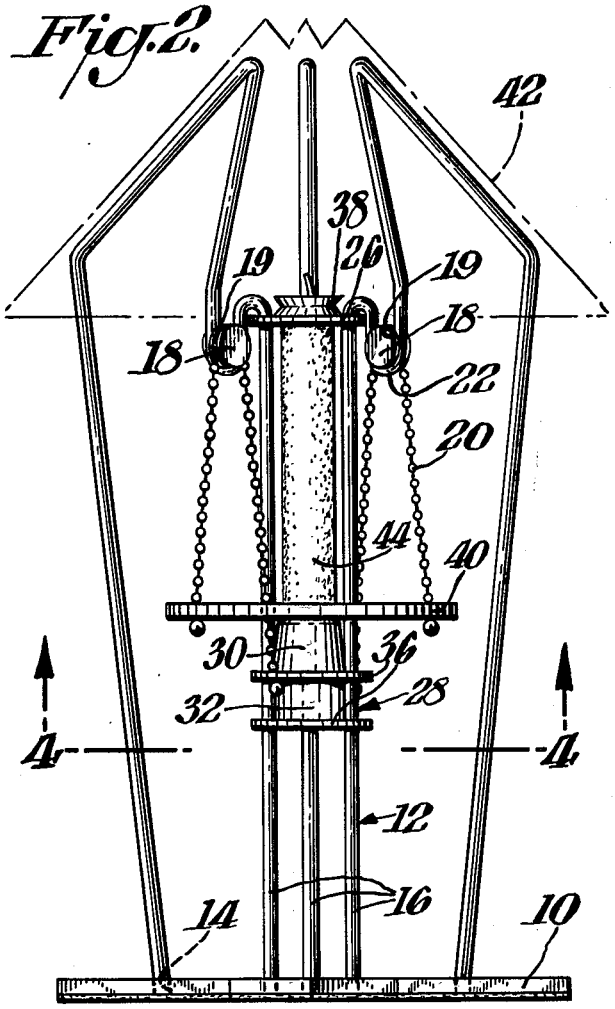

There may be seen in FIG. 1 an automatic candle feeder constructed in accordance with this invention which includes a base member 10. Secured equi-angularly about said base member are preferably three (more can be used as desired) upright supports 12 which may be soldered or brazed into receptacles 14 formed in the base member. Each of the upright supports 12 is in a general configuration of an upside down "U" with the open ends of the "U" being secured to the base. Actually, the outside portion of the U-shaped upright supports 12 may be omitted if desired with only the central, vertically oriented supports 16 being used. At the upper end of the vertical inner support 16 there are secured guideways 18 which are in the form of discs having peripheral grooves 19 which accommodate flexible linkages 20. These flexible linkages 20 may be a ball-chain or a conventional fine loop chain or any other type of flexible linkage capable of sliding over the groove 19 of the guideway 18. As may be seen in the drawing, the guideways 18 are pinched within a U-shaped bend 22 formed in the inner supports 16. They may be secured by other means such as brazing, if desired.

Figure 3:
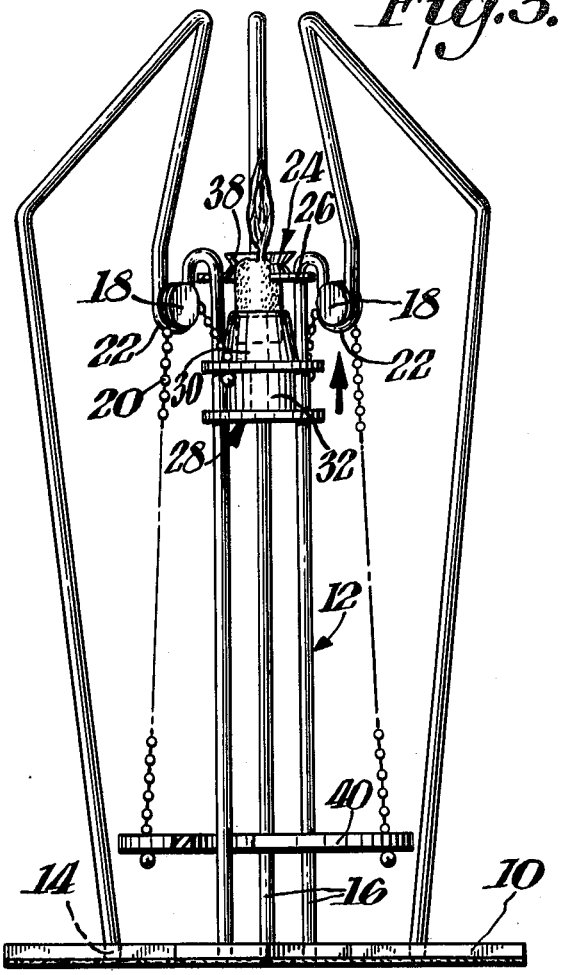
FIG. 3 is an elevation view of the automatic candle feeder of this invention in an operated position with the candle almost burned out.

The inner supports 16 are secured in a parallel relationship. At the upper end thereof are secured to a fixed top support ring 24. This top support ring 24 has an inside diameter that preferably is in the order of 0.07 inches less than the outside diameter of the candle to be used. In this connection it should be noted that the candles used should have a relatively constant diameter. This particular diameter dimension is not critical since the tolerance on most candles is not held with any high degree of accuracy and, of course, will vary with the type of wax employed in the candle. For example, with beeswax candles, rings of somewhat lesser diameter than the candle diameter may be used since the beeswax is a softer material and tends to melt at lower temperatures. In general, the inside diameter of the top ring can vary anywhere from 0.020 inches to 0.20 inches less than the outside diameter of the candle. The upper half of the top support ring is an inverted frusto-conical configuration such that it forms together with the candle a cup-like receptacle for containing the melted wax as the candle burns. The lower half 26 of the support ring 24 also is generally frusto-conical in shape such that as the candle is pushed into the ring it guides the candle and tends to squeeze wax into the central portion thereof as the wax softens. The sides of the cup-like receptacle, as may be seen clearly in FIG. 3, in the upper portion of the top ring 24 preferably form an angle $\alpha$ with the vertical of about 45° although it may vary from as little as 10° up to 90. Similarly, the downwardly opening angle $\beta$ of the sides of the frusto-conical lower portion 26 preferably is about 35° with the vertical, but may vary from a minimum of 10° up to about 80°.

The candle itself is supported by a lower or bottom drive member 28 which forms a shallow receptacle 30 for holding the candle itself (the receptacle preferably has a diameter slightly greater than the outside diameter of the candle and typically no more than 1/16 inch deep although variation here is permitted). The shallow depth is preferred to permit complete burning of all the wax as the candle burns itself out. The lower drive ring 28 is formed to have a lower guide portion 32 having either grooves or holes 34 which slide upon the inner supports 16. Preferably a pair of flanges 36 on the lower portion of the drive ring 28 provide a dual guide mechanism to prevent the drive ring from tilting, and thereby binding, although a single flange, if desired, may be used. The outer edge of the upper lip 38 of the receptacle 30 is bevelled such that it is able to fit within the lower portion 26 of the top support ring as the candle burns itself out.

The flexible linkages 20 are secured at one end to the lower drive ring 28, are equally angularly spaced and extend upwardly over the respective guideways 18 and then extend downwardly to be secured at the other end in the outer portion of a relatively heavy or weight ring 40, which hangs about the outside of the inner supports 16. The upright supports 12 may be formed in such manner as to support a shade 42 which may be of any desired design or configuration. Preferably, the shade is of a perforated material which provides for a distribution of the light beam or glare, and also keeps the shade cool. The hole in the top of the shade acts as a chimney and guides the tip of the candle flame to the center of the shade.

In operation, to introduce a candle 44 into the automatic candle feeder, the lower drive ring 28 is depressed thereby causing the weight ring 40 to move upwardly. The candle is inserted with the top or wick end fist into the top support ring 24 and then the lower drive ring 28 is permitted under the influence of the weight ring 40 to rise up to engage the bottom of the candle 44. The candle is continuously urged in an upwardly direction by the weight of the weight ring acting through the linkages 20 to continuously pull the lower drive ring 28 and, hence, the candle in an upward direction against the top support ring 24. The candle is now lit and the heat of the flame causes the wax to melt in a puddle which is held within the cup-like portion of the top support ring 24. As the support ring becomes heated, this process is aided somewhat in that the heated member causes the candle to be compressed as the wax heats up, softens and melts. As the burning continues, finally the lower lip of the lower drive ring 28 engages the lower portion 26 of the top support ring 24. At this point, the upward movement of the candle stops; burning, however, continues and, because of the shallow receptacle 30, virtually all of the wax is burned.

This rather simple, passive type device for automatically feeding the candle is not only unique, but is relatively trouble free and has a relatively long life, at the same time providing a fascinating object for the user to observe during the burning of a candle.

It is obvious that many embodiments may be made of this inventive concept, and that many modifications may be made in the embodiment hereinbefore described. Therefore, it is to be understood that all descriptive material herein is to be interpreted merely as illustrative, exemplary and not in a limited sense. It is intended that various modifications which might readily suggest themselves to those skilled in the art be covered by the following claims as far as the prior art permits.

What I claim is:

1. An automatic candle feeder comprising, in combination:

a base, a plurality of symmetrically positioned upright support rods secured to said base, a fixed top support ring mounted on said rods and adapted to engage the top peripheral portions of said candle, a lower drive ring slideably mounted on said rods and adapted to support and urge said candle upwardly toward said top support ring, a ring weight surrounding said rods, plural guideways secured to said rods contiguous said top support ring, and flexible linkages slideably movable over said guideways linking said ring weight and said lower drive ring, thereby to urge said lower drive ring and hence said candle upwardly.

2. An apparatus according to claim 1 wherein said lower drive ring defines a tapered top portion, and said top support ring defines a downwardly opening frustoconical configuration adapted to engage said tapered portion, thereby to facilitate more complete burning of said candle.

3. An apparatus according to claim 2 wherein said lower drive ring defines a shallow receptacle for said candle, thereby to facilitate complete burning of said candle.

4. An apparatus according to claim 1 wherein said top support ring has an upwardly opening, inverted frustoconical configuration, thereby to direct melting wax toward the center of said ring.

5. An apparatus according to claim 1 wherein said top support ring together with said candle defines a cup-like configuration to contain said was.

* * * * *